United States Patent [19]

Teja

[11] 4,275,902

[45] Jun. 30, 1981

[54] CRANE OR EXCAVATOR WITH AUXILIARY MECHANISM FOR TRANSFERRING SUPERSTRUCTURE LOADS TO THE GROUND

[76] Inventor: Mohindar S. Teja, 2367 E. Larpenteur Ave., Apt. 110, St. Paul, Minn. 55109

[21] Appl. No.: 69,436

[22] Filed: Aug. 24, 1979

[51] Int. Cl.[3] ..... B66C 23/78

[52] U.S. Cl. ..... 280/766; 212/189; 280/767; 414/694

[58] Field of Search ..... 212/28, 59 R, 145, 189; 414/694; 280/763, 764, 765, 766, 767; 198/302, 306

[56] References Cited

U.S. PATENT DOCUMENTS

| | | | |
|---|---|---|---|
| 2,346,900 | 4/1944 | Black | 212/145 X |
| 3,109,542 | 11/1963 | Noll et al. | 212/145 X |
| 3,552,546 | 1/1971 | Rath | 198/306 |

FOREIGN PATENT DOCUMENTS

| | | | |
|---|---|---|---|
| 1271937 | 7/1968 | Fed. Rep. of Germany | 212/145 |

*Primary Examiner*—Jeffrey V. Nase
*Attorney, Agent, or Firm*—Delbert J. Barnard

[57] ABSTRACT

The crane or excavator includes a revolving superstructure which is supported on a carrier frame for rotation about a vertical axis by means of a turntable. The superstructure carries a linear hydraulic motor which includes a downwardly directed, normally retracted, piston rod having a support pad at its lower end. A secondary ground engaging frame positioned endwise of the carrier frame includes an upper reaction surface. The main frame includes a side positioned shelf also having an upper reaction surface. Both reaction surfaces are within the swing path of the linear hydraulic motor. In operation, the linear hydraulic motor is positioned over one of the reaction surfaces and the piston rod is extended into a load transferring contact with the reaction surface. The linear hydraulic motor may be automatically extended into bracing contact with a reaction surface simultaneously with delivery of hydraulic fluid to a hydraulic component carried by the superstructure, the actuation of which creates a need for bracing action.

10 Claims, 19 Drawing Figures

CRANE OR EXCAVATOR WITH AUXILIARY MECHANISM FOR TRANSFERRING SUPERSTRUCTURE LOADS TO THE GROUND

SUMMARY

This invention is based on the U.S. Patent Office disclosure document number 074978 dated Oct. 12, 1978. Cranes and excavators of the prior art provide a single means of transferring all of the forces and loads from the upper frame to the lower frame and to ground via the single fulcrum between the upper and lower frames. The applicant's invention provides plurality of means for transferring forces from upper to lower frame and ground. Thus prior art devices have shorter life for comparable component specification. Applicant is able to increase the life by providing an additional means of transferring forces from upper structure of the machine (digging or lifting) to the ground, by which the major part of the forces go directly to the ground through the supporting member instead of going through the main structures, thereby avoiding high stresses in the structures and eventually avoiding a structural failure. Without the applicant's means of transferring forces from upper structures; to the ground, the structures must be exceptionally heavy and costly as is done in present art. With applicant's improvement machine reliability goes up and cost goes down and resulting in substantial improvement in performance.

Since the applicant is familiar with the prior art, a search was not conducted. Objectives of the applicant's invention may be summarized as follows.

1. To increase the stability of excavators, cranes and like machines.
2. To increase the life and reliability of excavators, cranes and like machines by improving MTBF (Mean Time Between Failures).
3. To reduce the cost of maintenance of excavators, cranes and like machines.
4. To improve the performance substantially over prior art cranes and excavators and the like machinery.
5. To modularize the improvement such that existing prior art cranes and excavators can easily accommodate and thereby benefit from applicant's teaching.
6. To design the improvement such that it lends itself to easy installation and maintenance.
7. To design the improvement such that it can be used on cranes and excavators of all types and sizes.
8. To design the improvement such that the operator of the machine has to assume no additional operational responsibilities.
9. To design the improvement such that no major limitation is placed on the functions and uses of the prior art cranes and excavators.
10. To design the improvement such that prior art cranes and excavators and like machines can be used for any angle of rotation.
11. To change the nature of load forces on main frames.
12. To improve the transportation of excavators, cranes and like machinery from one site to another.

Other objectives of this invention may reside in its simplicity, strength and mode of construction and installation as will be evident from the following description.

DETAILED DESCRIPTION OF THE PREFERRED EMBODIMENT

Since the teaching of cranes, excavators and like machinery is well known to those of ordinary skill in the prior art, this disclosure is limited to only those parts of prior art excavators, lift cranes and the like machinery which interface directly with the applicant's improvement. An excavator, lift crane or like machinery of the prior art comprises two major frames or structures to wit the upper frame unit and the lower frame unit which are pivotally connected to each other. The ıpplicants invention is an improvement which also :omprises two additional structures to wit upper sup-ıort member and the lower support member. The upper upport member of the applicants improvement is per-nanently fastened to the upper frame unit of the prior .rt and the lower support member of the applicant's mprovement is permanently fastened to lower frame ınit of the prior art.

While the upper and lower frames are permanently lirectly and pivotally connected to each other, the ıpper and lower support members are engaged or disen-;aged depending upon the mode of operation. In the ree, non-working, disengaged position the only con-ıection between the upper and the lower support mem-ıers is via the upper and lower frame units of the prior .rt. However, during the engaged position the upper nd lower support members are directly connected hereby providing an additional path for transferring orces to ground, which in turn reduces stresses on the ıivotal connection between the upper and lower frame ınits.

Figure 1:
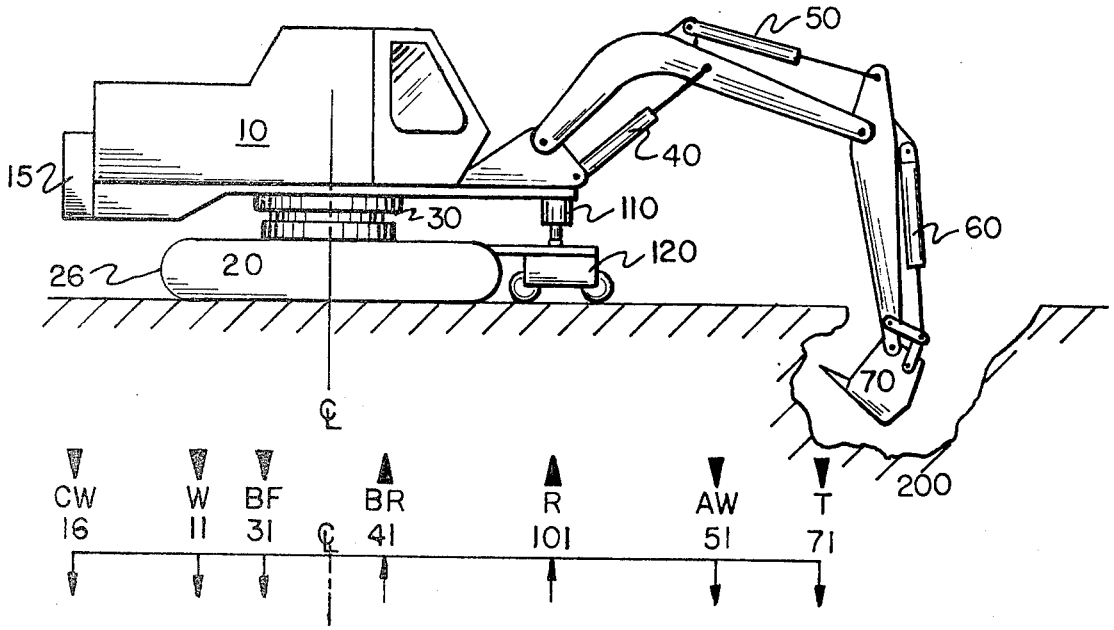
FIG. 1 is a side view of an excavator in the digging position which also shows the conventional forces and location of applicants improvement.
Figure 2:
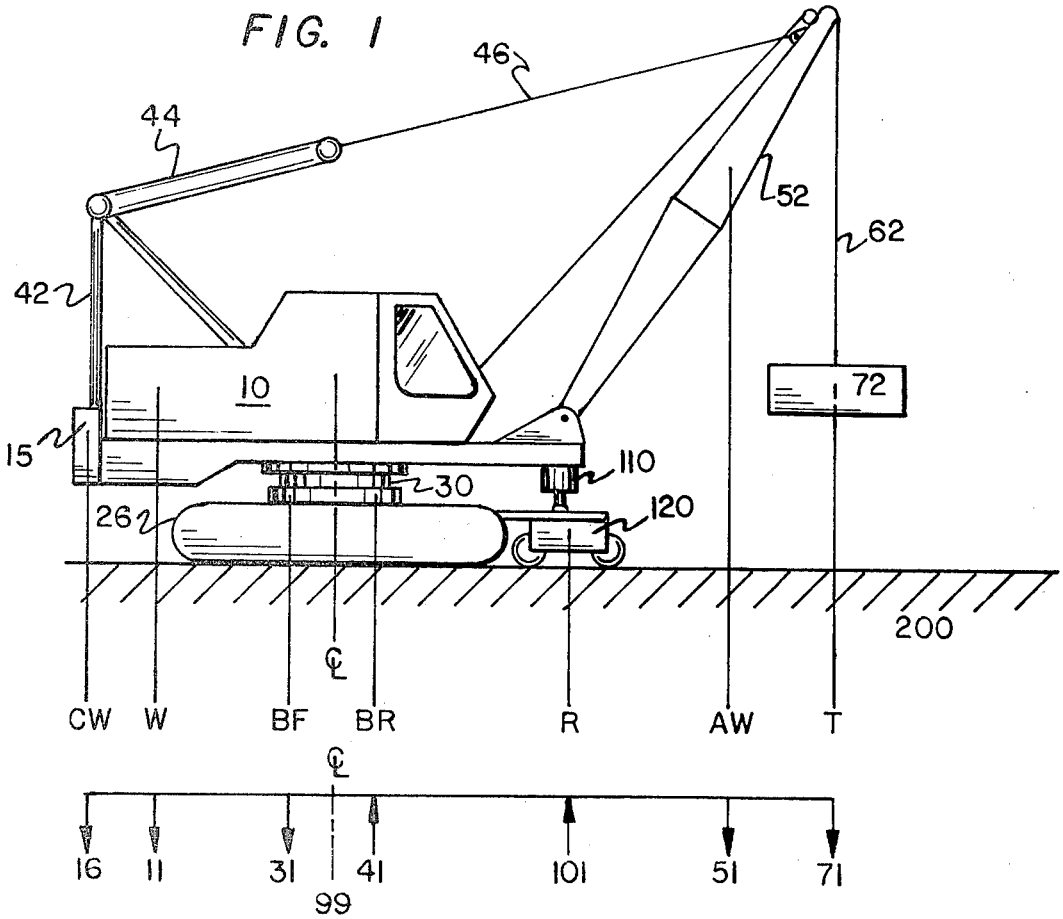
FIG. 2 is a side view of a lift crane also showing the applicant's improvement and conventional forces.

FIGS. 1 and 2 show side views of an excavator and ift crane respectively. Also shown on these figures are 'arious forces and their direction, wherein from left to ight CW stands for force (16) due to counterweight 15), W for weight due to center of gravity of the upper rame unit (11), BF for bearing force (31), C for center f rotation (99), BR for bearing reaction force (41), R or support reaction (101) due to applicant's improve-ıent, AW for load (51) due to attachments such as ucket, hoe, etc. and T for verticle bucket load (71) uring digging in case of an excavator or during lifting ı case of a lift crane.

A lift crane of the prior art comprises an upper re-olving frame 10, lower carrier frame assembly 20, onnected to each other revolveably via a bearing as-embly 30. In addition a counter weight 15, a pair of rawlers 26 and 27, a boom suspension system 42, 44, 46, boom 52, load hoist rope 62, a load 72. A hydraulic ystem 80 and a reservoir 92 as well as an engine and perator control panel (not shown) are inherent part of ıch a machinery.

The excavator apparatus of prior art comprises upper evolving frame assembly 10, lower carrier frame as-embly 20 connected to each other revolveably via a earing assembly 30. A counter weight 15, a pair of rawlers 26 and 27, hoist cylinder assembly 40 (gener-lly comprising two cylinders), dig-extend cylinder ssembly 50, a tilt-dump cylinder assembly 60 and an utput unit such as a bucket 70 or a hoe or the like, an ydraulic system 80, a reservoir 92, and an engine and n operators control panel (now shown) are an inherent art of such apparatuses. This invention comprises an pper supporting member 110 including a cylinder 12) or (114) connected to revolving frame 10 and a ıwer supporting member 120 connected to lower car-er frame 20 and including a roller (145). The invention so comprises a valve (132) connected to hydraulic ısembly 80 and reservoir 92 and 94, as shown in FIGS. and 4 respectively.

Thus maximum dig force due to tooth force (bucket ) tooth) or breakout force is prevented or limited from ɔing through revolving frame 10 and lower frame 20 ar body and tracks) by supporting the revolving frame ) just below or in the vicinity of hoist cylinder 40 ıpport. During digging the load caused by digging (or eaking out) force can be transferred to ground ırough this invention 'R' support (101). By using this concept heavy load cycles are avoided on the crane or excavator (main machine) and counter weight can be eliminated or reduced.

Figure 3:
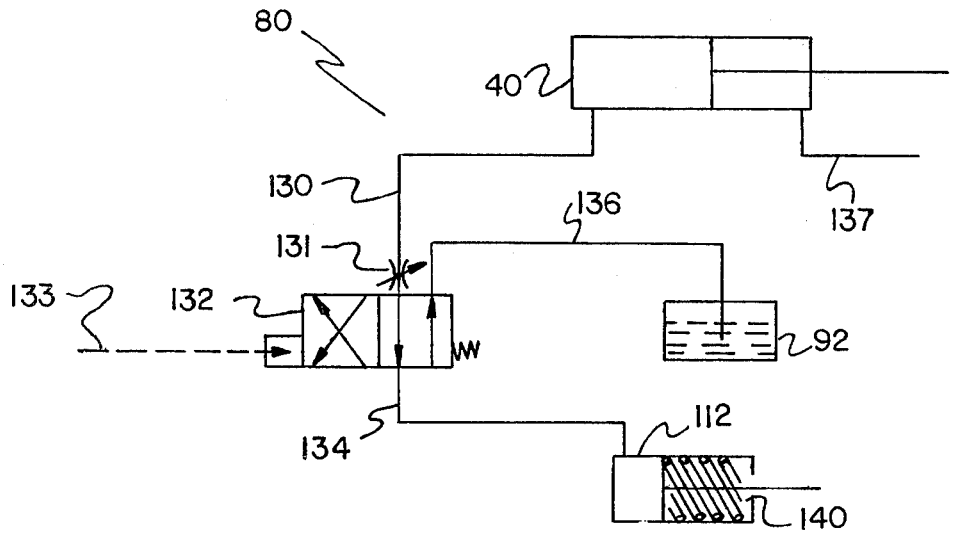
FIG. 3 is a hydraulic circuit diagram used in the preferred embodiment, wherein a single action spring type cylinder is used.
Figure 4:
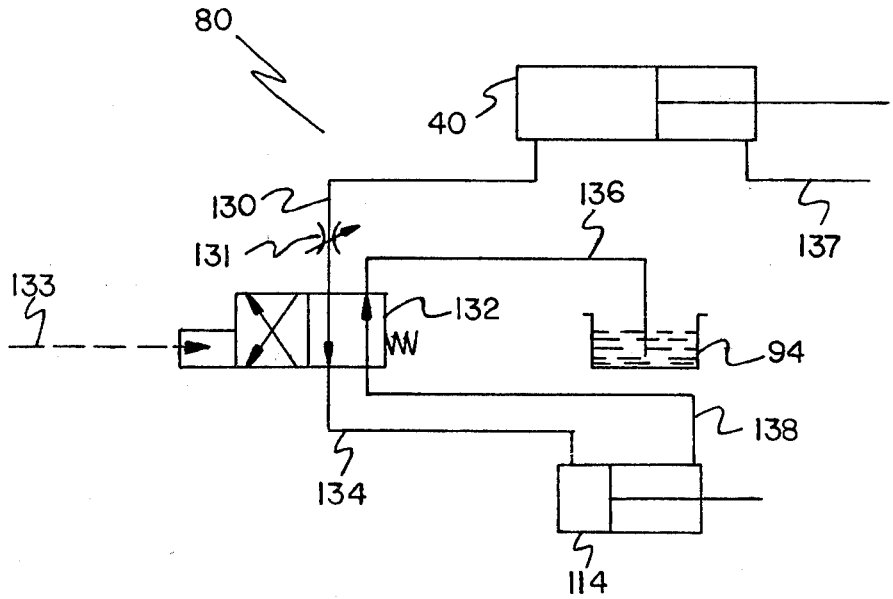
FIG. 4 is an alternate hydraulic circuit diagram wherein a double action type cylinder and an open reservoir are used.

The lower supporting member 120 with its concomitant roller 145 is a floating structure which can move up and down and sideways within predetermined limits and also at different angles according to the ground conditions. The upper supporting member 110 includes a compact hydraulic cylinder 114 which as shown in FIG. 4 is a double action type or as shown in FIG. 3 it may be a single action spring return type cylinder 112. This cylinder 112 is activated by the pressure from the hoist cylinder 40 or elsewhere from the hydraulic sub-system 80. Said upper support unit 110 swings freely (with no or little load) relative to the upper revolving frame 10. In addition a dump valve (not shown) which can quickly react to the pilot pressure from the hydraulic subassembly 80, may be used to increase the response time of the deactivation of this invention. The hydraulic pilot pressure may be obtained from the swing circuit or revolving frame and turning circuite of the hydraulic subassembly.

FIG. 3 shows the preferred embodiment of the connection between single action cylinder 112, valve 132, pressurized reservoir 92 and the hoist cylinder 40. Similarly FIG. 4 shows an alternate embodiment of the connections between double acting cylinder 114, open reservoir 94, valve 132 and hoist cylinder 40. Either embodiment also shows connection to pilot pressure 133, orifice 131 between the hoist cylinder 40 and valve 132 helps control the response time further if necessary.

In either hydraulic circuit a hydraulic line 130 connects prior art hoist cylinder 40 to hydraulic valve 132 which is a two position, 4 way, pilot controlled spring returned type, via an orifice 131. Also connected to valve 132 is pilot line 133, and as hydraulic line 134 which connects said valve 132 to cylinder 112 or 114 of applicants improvement. The hoist cylinder 40 has rod end pressure line 137 connected to it. Hydraulic line 136 connects the valve 132 to a pressurized reservoir 92 in case of single action spring type cylinder of preferred embodiment or to an open ended non-pressurized reservoir 94 in case of double acting cylinder 114 of the alternate embodiment. (Pressurized reservoir has no bearing in choosing type of cylinder). In the latter case the double action is made possible because of an additional hydraulic connection 138 between valve 132 and cylinder 114. In either case the pilot operated valve 132 is connected to operator's console such that it opens automatically each time dig control is activated, or the turning gear is engaged.

Figure 5:
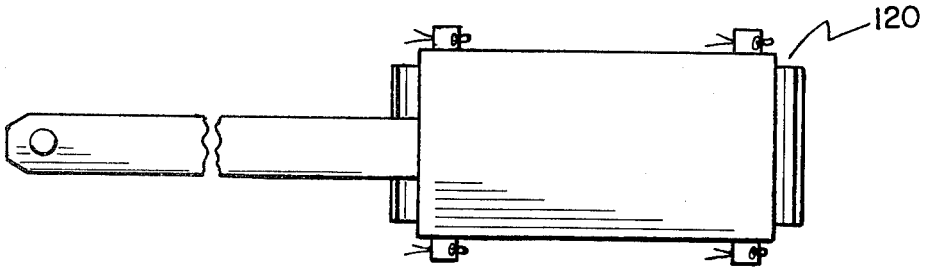
FIG. 5 is a top view of the lower support member of this invention.
Figure 6:
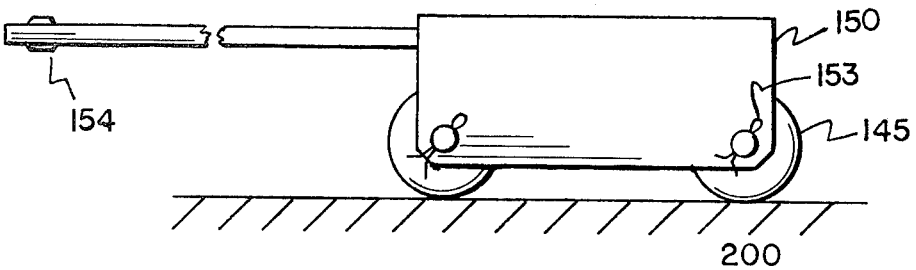
FIG. 6 is a side view of the lower support member of this invention.
Figure 7:
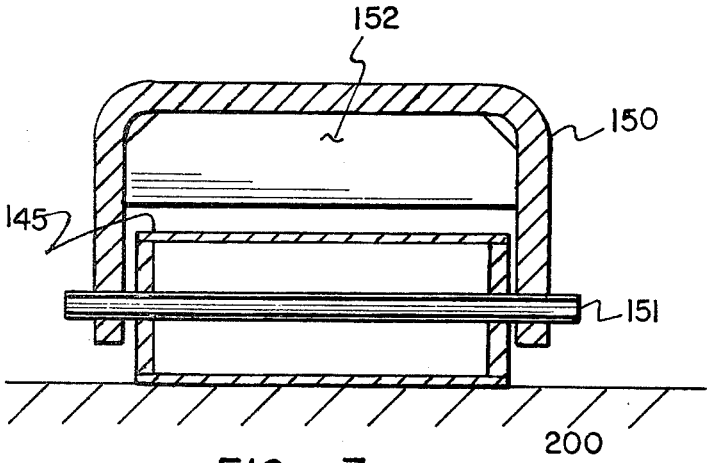
FIG. 7 is a sectional view of the roller as part of the lower support member.

FIGS 5, 6 and 7 show top, side and sectional views of lower member of the preferred embodiment of the improvement of this invention. In the preferred embodiment two rollers 145 are fastened under a 'U' shaped bracket 150 with a pin 151. Item 152 is frequently used to reinforce bracket 150. A swivel ball joint 154 is also provided in the preferred embodiment for carrier flotation.

Figure 8:
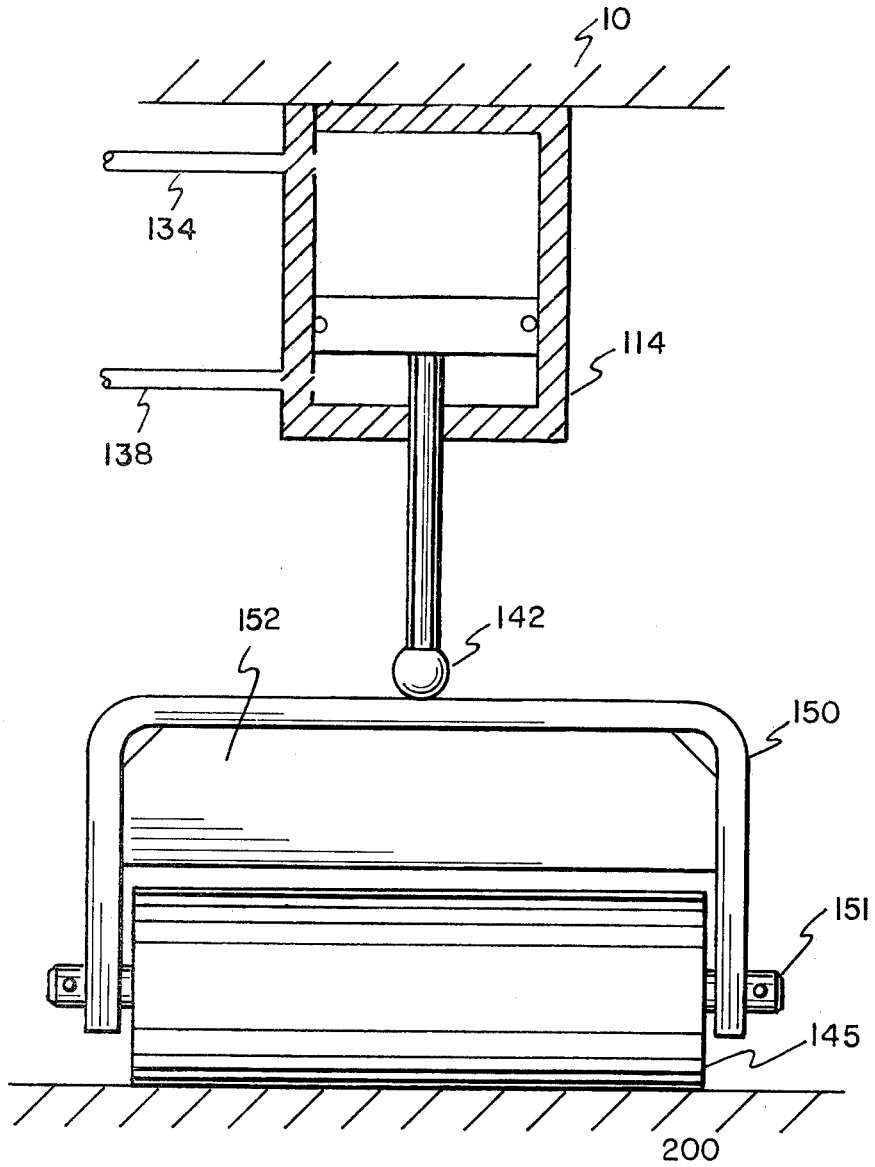
FIG. 8 is a back view of the improvement of this invention showing the upper and the lower members engaged in the working position, to wit digging or lifting the weight.

FIG. 8 is the back view of the lower support member coupled with a sectional view of the upper support member 10. The upper support member in this configuration comprises a double acting cylinder 114, having hydraulic pressure inlet and outlet 134 and 138 respectively. Swivel ball joint 142 is also shown which is used to avoid any side loading on the cylinder 114 rod and piston.

Figure 9:
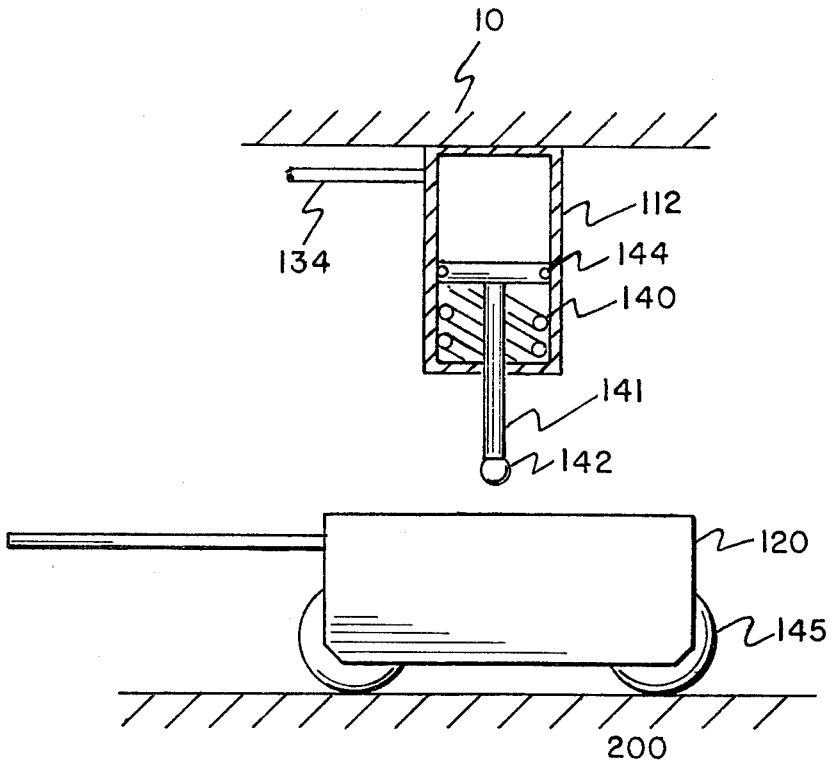
FIG. 9 is a side view of the upper and lower support members in free or disengaged, or non-working positions.
Figure 10:
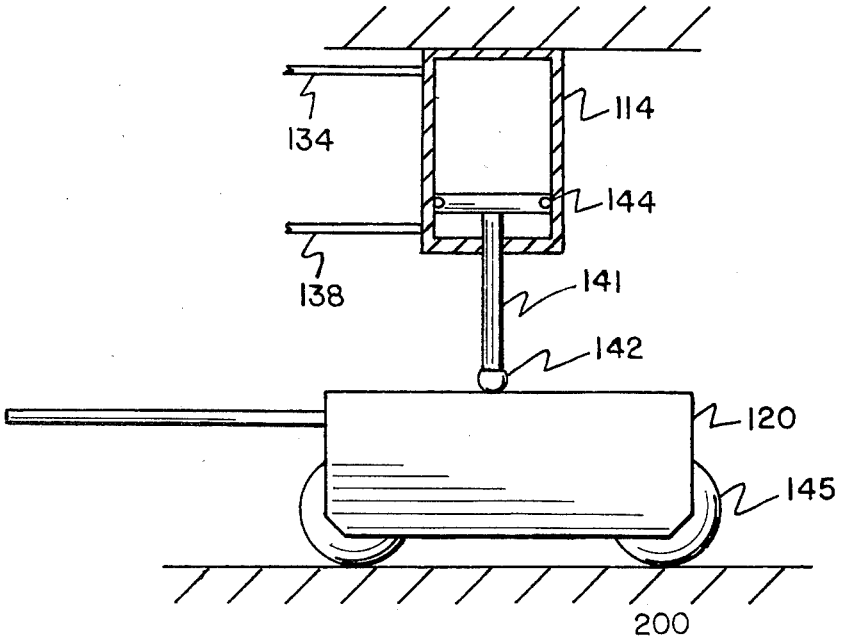
FIG. 10 is a side view of the upper and lower support members shown in the engaged, working position.

FIGS. 9 and 10 show side views of disengaged and engaged position between the upper support member 10 and lower support member 20. In FIG. 9 a single action spring return type cylinder is shown. In FIG. 10 a double action type cylinder is utilized. The figures also show spring 140, roller 145, cylinder rod 141, cylinder rod end ball 142, cylinder piston and seal 144. The upper support member 110 is connected to upper frame 10 and the lower support member is 120 is resting on ground 200 and is also pivotally connected to lower support member 20.

Figure 11:
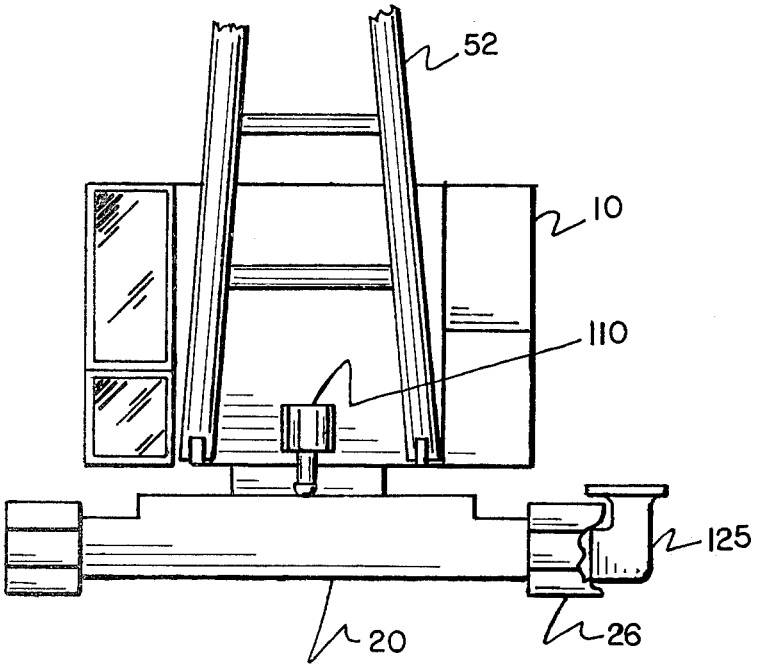
FIG. 11 is a front view of the lift crane showing the location of the improvement of this invention.
Figure 12:
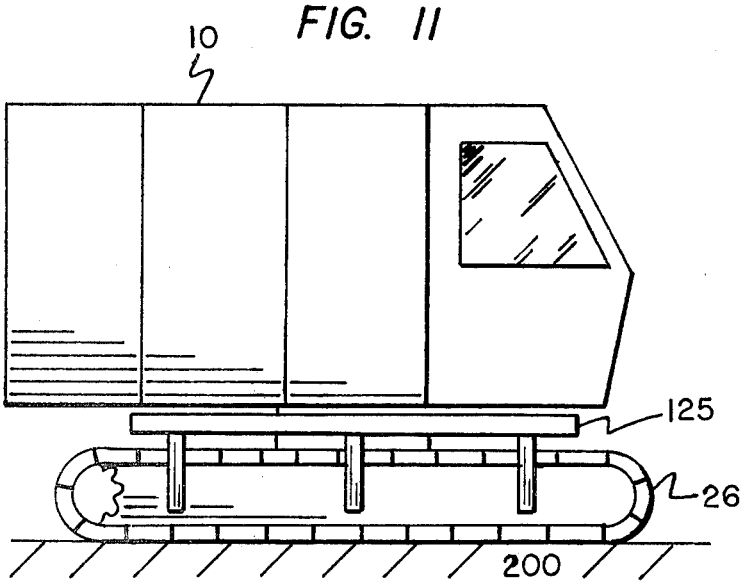
FIG. 12 is a side view of the upper and lower frames of an excavator which shows the location of the lower member of the improvement of this invention.
Figure 13:
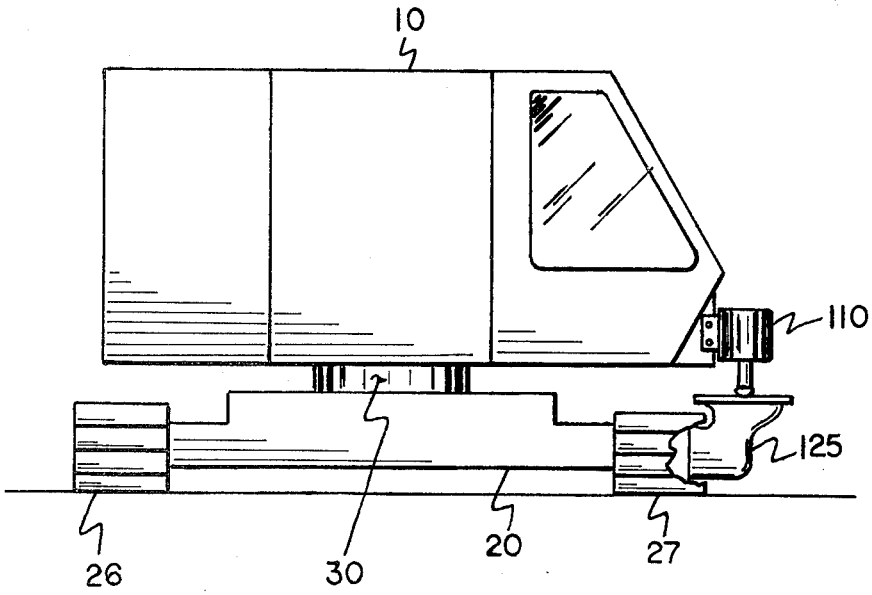
FIG. 13 is a side view of the upper frame unit combined with a front view of the lower frame unit that is after rotation of 90 degrees, showing the location of the upper and lower members of the improvement of this invention.
Figure 14:
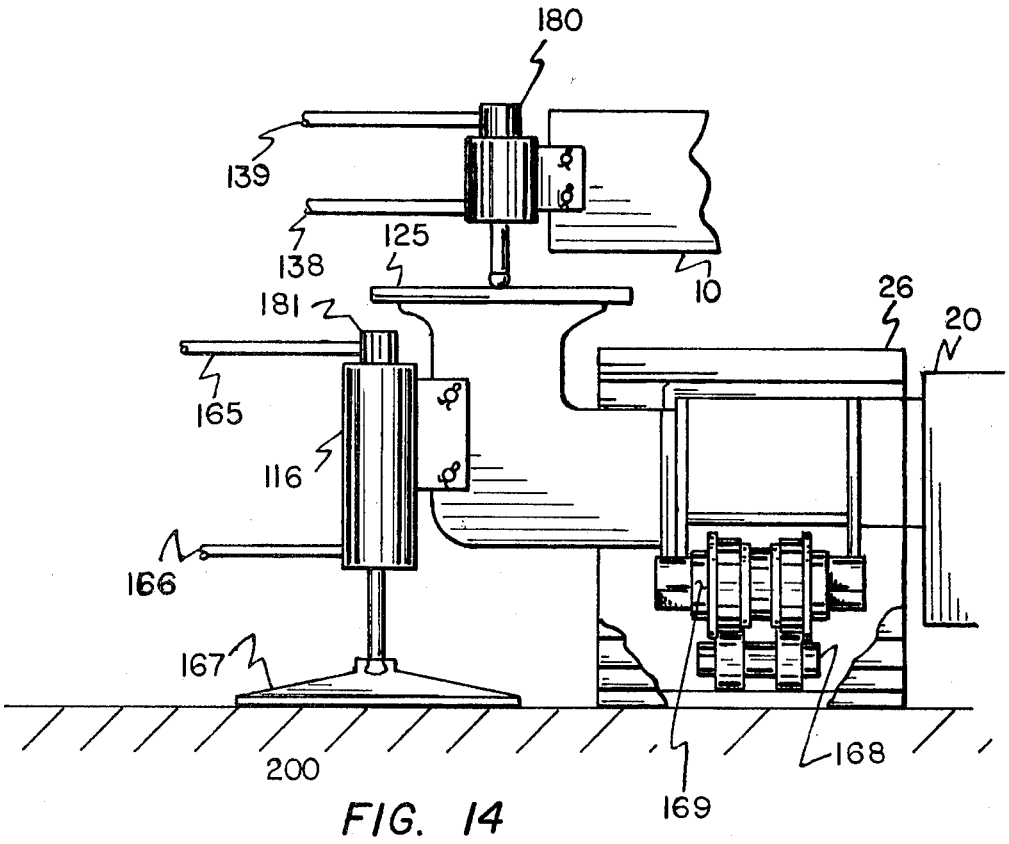
FIG. 14 is also a close up view of the alternate embodiment of this invention in which an additional hydraulic cylinder is added to the lower support member for increased stability and structural support.

FIG. 11 shows an alternate design 125 for lower support member (120), which is mounted directly to the crawler frame 26 as shown in the side view of lift crane. In this configuration the roller carrier design shown in FIGS. 1 and 2 are obviated but the same function is performed. This type of support is preferably used when the excavator or the crane or the like machinery is being used over sides instead of front and rear. FIG. 13 combines the side view of the upper frame 10 with the front view of the lower frame 20 after 90° of mutual rotation. The upper member 110 is the same in either configuration. FIG. 14 shows an enlarged version of this lower side support member 125; which also shows track chain 168, track roller 169. The configuration of FIG. 14 also shows an additional optional hydraulic cylinder 116, where 165 and 166 are hydraulic lines. A support pad 167 for cylinder 116 is also shown. A lock valve 180 may be added to cylinder 110 and a similar lock valve 181 may be added to cylinder 116 for saftey reasons only for crane applications. The pressure lock valves 180 and 181 protect the machine from tipping in case of hydraulic line failure.

Figure 15:
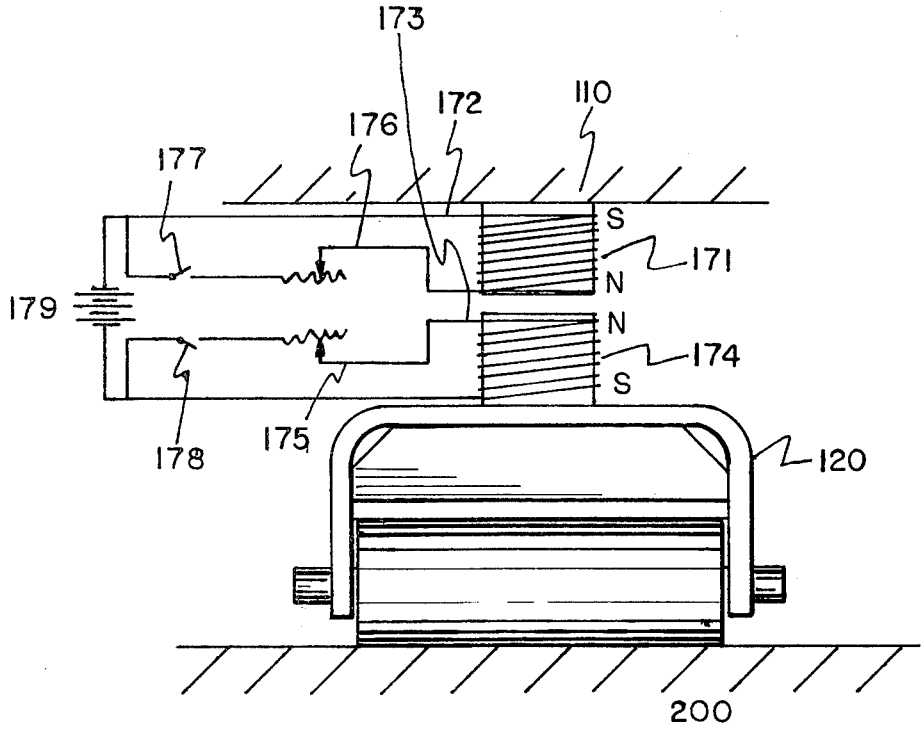
FIG. 15 is the front view of the lower support member using the electromagnetic flux as an alternate medium of transferring loads and associated circuitry.

FIG. 15 shows electromagnetic flux as the medium for transference of energy or load from upper support member 110 via lower support member 120 to ground 200. This is done with electromagnets 171 and 174, where electromagnet 171 is permanently fastened to upper member 110 and the electromagnet 174 is fastened permanently to lower member 120, which in turn are connected to upper and lower frame units 10 and 20 respectively. Cables 172 and 173 are provided to carry current from an energy source 179 to magnetic coils of electromagnets 171 and 174. Variables resistors 175 and 176 are used in series to vary the power in the electromagnets, which in turn controls the flux and the force between electromagnets 171 and 174. Switches 177 and 178 are provided to energize or de-energize the electromagnets 171 and 174. In this configuration there is no direct physical connection between the upper and the lower support members and therefore there is nothing to wear and therefore the reliability is higher.

DETAILED DESCRIPTION OF THE ALTERNATE EMBODIMENT

The objective in the alternate embodiment is to further improve crane capacity substantially. This alternate embodiment is particularly suited for lift cranes rather than excavators. In the alternate embodiment a self propelled member is pivotally fastened to upper revolving frame of the lift crane under the boom. This support member travels under boom feet with its own power as the lift crane is rotated thereby providing a continuous support. Power to the member can be provided by electric or hydraulic motor or any other convenient power source. As will become apparent from the following detailed description, the alternate embodiment includes means for lifting, securing and rotating the self propelled member with respect to the upper revolving frame of the lift crane. Either lifting or rotating is necessary before the lift can be rotated. Unsecuring is advisable when the entire lift crane is to be transported to a different location to avoid undesirable stresses. Securing is advisable during working of the lift crane.

Self propelled member 100A is most valuable for lift crane and drag line applications. The self propelled member 100A transforms most of the load directly to the ground instead of going through the entire machine since said self propelled member 100A is located directly under the boom of a lift crane. The principle of transferring forces from revolving frame to ground, discussed in detail in the preferred embodiment is equally applicable in the alternate embodiment.

Figure 17:
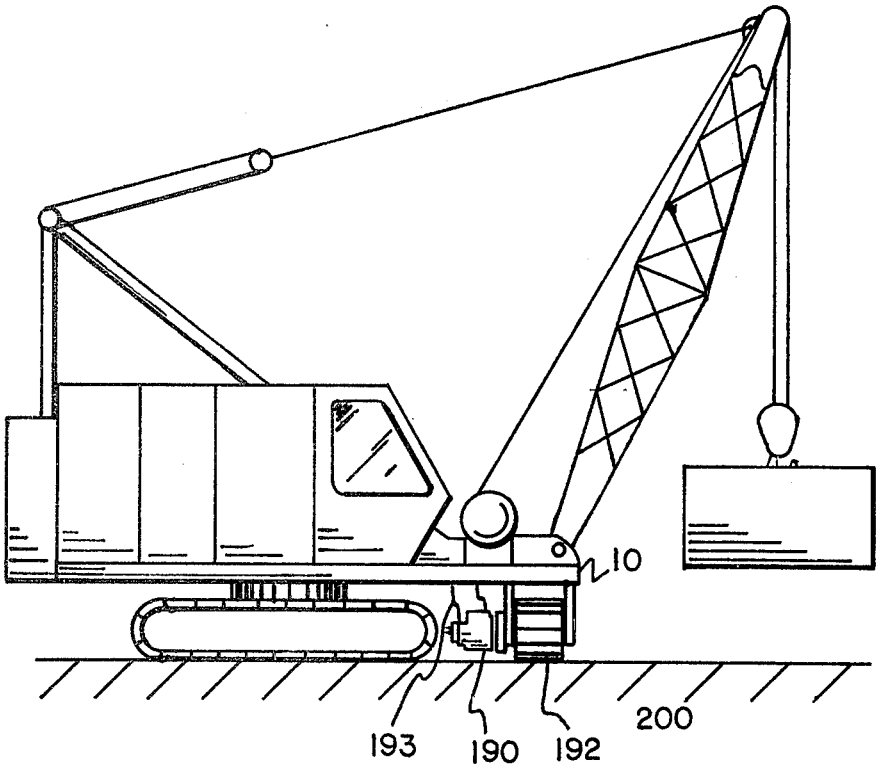
FIG. 17 is a side view of the crane showing location of applicant's improvement in alternative embodiment.
Figure 18:
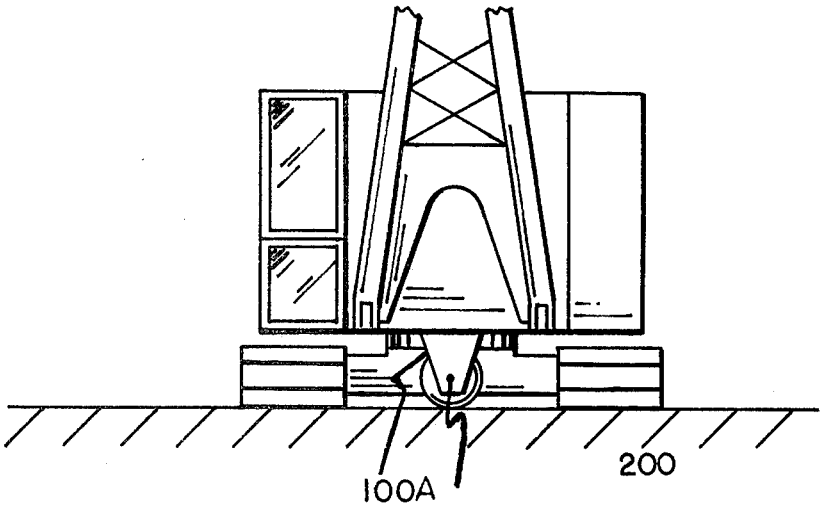
FIG. 18 is a front view of the lift crane showing the self propelled member as an alternative embodiment of applicant's improvement.
Figure 19:
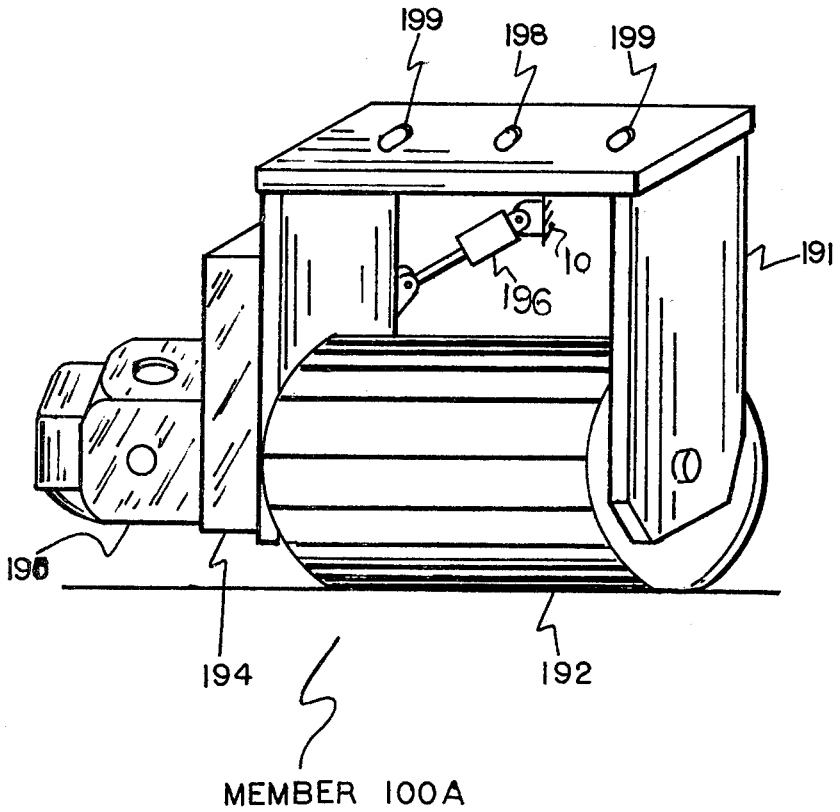
FIG. 19 is a perspective of the self propelled member as an alternative embodiment of applicant's improvement.

FIG. 19 shows a perspective view of the self propelled member 100A and is shown attached to lift crane revolving frame 10 in FIGS. 17 and 18. Self propelled member 100A can be designed either to be lifted off the ground with the assistance of a hydraulic cylinder 196 or be turned at 90 degrees to follow the tracks 26 and 27 during machine travel. A support member 191 in the shape of an inverted 'U' used for supporting roller(s) 192 and is pivotally and permanently fastened to upper revolving frame 10. Roller 192 can be replaced by a plurality of rollers or a smaller track similar to 26 and 27. As shown in FIGS. 17 through 19 the preferred design of the alternate embodiment utilizes a single roller. The length and the diameter of the roller or rollers 192 are calculated to provide a reasonable ground pressure and to suit the size of the machine and such factors and techniques are well known to those of ordinary skill in this high skill art.

A gear box 194 is used to reduce mechanical shaft, hydraulic motor or electric motor speed and to increase its torque. The gear box specification depend on torque and speed requirements. Gear box 194 output shaft turns the roller 192. A hydraulic cylinder 196 is used with one end attached to said inverted 'U' shaped support member 191 the other to revolving frame 10. The cylinder is provided to rotate self-propelled member 100A about 90 degrees to facilitate machine travel. A roller or plurality of rollers 192 are turning in a similar manner as the machine tracks 26 and 27 during machine travel.

A pivot hole 198 is incorporated in inverted U shaped support member 191 to allow entire self propelled member 100A to rotate. It is for this reason self propelled member 100A is attached to revolving frame 10 with a pin (not shown) which keeps the member 191 from separating from revolving frame as well as serves as a fulcrum for rotating. Two more holes 199 are also bored in inverted 'U' shaped support member 191. These holes are to bolt self propelled member 100A to revolving frame during working of the machine (special application such as dock work, scrap yard). These bolts (not shown) are removed during long machine travel to allow self propelled member 100A to rotate freely to avoid undesirable stresses.

Another alternate design of self propelled member 100A is to lift it off the ground with hydraulic cylinder for long travel of the machine, which is not shown as well as many other improvements which may be made without deviating from the spirit of this invention. As for example, with minor modifications in design this concept can be extended for operation of the excavator or lift crane for any turning angle between the longitudinal axis of the revolving frame 10 and the carrier frame 20, even though the drawings in this disclosure show a turning angle of 0, 90, 180 and 270 degrees. Similarly one may vary the number of rollers 122 used from one to a plurality of 4 or more without deviating from the spirit of this invention. The applicant has kept this disclosure concise in the interest of ease of comprehension. Examples of other variations within the scope of this invention but not specifically disclosed or claimed are reductions of hydraulic response time by utilizing additional operating angle range control and dump valves; and obtaining hydraulic pressure from a different source.

Following is a listing of the reference numerals used in the preferred and alternate embodiments arranged in their ascending order. Typical specifications to identify the components where appropriate have also been added.

10=Upper frame unit of prior art excavator/crane
11=Weight of the upper frame unit
13=Distance of the weight of the upper frame unit from the center of rotation 99
15=Counter weight
16=Downward force of the counter weight 15
18=Distance between the counter weight 15 and the center of rotation of the machine 99
20=Lower frame unit of prior art excavator/crane
26=Crawler frame
27=Opposite crawler of an excavator or lift crane of prior art
30=Bearing assembly
31=BF=Slewing bearing bolt tension force
33=Distance between BF (31) and center of rotation 99
40=Hoist cylinder of an excavator
41=BR=Bearing reaction force
42=Gantry to mount lower spreader and support load through boom suspension system
43=Distance between bearing reaction force BR (31) and center of rotation
44=Boom hoist rope and spreaders to position the boom
46=Boom pendent
50=Attachment cylinder on an excavator
51=AW=Load of attachments such as bucket, boom, cylinders and jib, etc.
52=Crane boom
53=Distance of AW (51) from the center of rotation 99
60=Tilt cylinder assembly of an excavator
62=Load hoist rope of a lift crane
70=Load bucket of an excavator or lift crane
71=T=Tooth force during digging or hook load during lifting
72=Load being lifted by a crane
73=Distance between T (71) and center of rotation 99
80=Hydraulic System
90=Reservoir
92=Pressurized reservoir
94=Open reservoir
99=Center of rotation of the entire machine
100=The applicant's invention as a whole
101=Reaction provided by applicant's invention
103=Distance between R (101) and center of rotation 99
110=Upper support member of this invention
112=Single action spring return type cylinder
114=Double action type cylinder
116=Additional cylinder for side support
120=Lower support member of applicant's invention
125=Lower side support member
130=Hydraulic connection between hoisy cylinder 40 and hydraulic valve 132
131=Orifice (fixed or variable) to hydraulic valve 132
132=Two position four way pilot controlled spring return type valve
133=Hydraulic pressure pilot line
134=Hydraulic line connecting valve 132 to cylinder 112, or 114
136=Hydraulic connection between valve 132 and reservoir 90
137=Hydraulic connection to hoist cylinder 40 rod end
138=Additional hydraulic connection between valve 132 and double action type cylinder 114
140=Spring of a single action type cylinder
141=Piston rod of a cylinder
142=Ball at the end of a piston rod of a cylinder 112 or 114
144=Cylinder piston and seal
145=Roller attached to lower support member
150=U shaped bracket
151=A pin for holding roller in U shaped bracket
152=Reinforcement member for bracket 150
153=Cotter pin for holding roller 145 in U shaped bracket
154=Swivel ball joint for carrier flotation
165=Hydraulic line for additional cylinder 116 shown as connected to lock valve 180
166=Hydraulic line for additional cylinder 116 shown as connected to lower cylinder port
167=Support pad for supporting rod end force of cylinder 116 and distributing the force over larger area of ground 200
168=Track chain
169=Track roller
171=Electromagnet fastened to upper support member
172=Cable connection between electromagnet 171 and energy source 179
173=Cable connection between electromagnet 174 and energy source 179
174=Electromagnet permanently fastened to lower support member 120 of this invention
175=Variable resistor
176=Variable resistor
177=Single pole single throw switch
178=Single pole single throw switch
179=Electrical energy source
180=A lock valve for cylinder 110
181=A lock valve for cylinder 116
190=Drive member
191=Support member
192=Roller member
193=Power connection between drive member 190 and power source
194=Gear box
196=Hydraulic cylinder
198=Mounting hole
199=Mounting hole

DESIGN THEORY AND OPERATION

Under prior art configuration the entire bearing assembly 30 via upper and lower frames 10 and 20 respectively experiences torturous three dimensional forces due to the load and the work being performed.

The combination of the upper and lower members 120 and 110 makes a supporting member 'R' (101) which helps bypass the cycle loads and the excessive stresses. Thus severe cycle loads and stresses are transferred to the ground through supporting members 101 of this invention instead of the crane or the excavator structures, 10 or 20. FIGS. 9 and 10 show the positions of the piston for the unactivated and activated mode. Only in the activated mode the invention bypasses stresses and forces through this invention. Under the inactivated mode the excavator or the crane operates normally as if the invention were not incorporated. This deactivation is triggered by engaging the swing mode on the operator console so that the operator is not required to operate any additional controls.

With reference to FIG. 3 the operation of the hydraulic circuit in the preferred embodiment is as follows. As soon as thw swing mode is engaged the dump valve 132 shifts to shut off the hoist cylinder 40 pressure and flow and dumps the support cylinder 112 pressure back to the hydraulic reservoir 90. This reservoir may be pressurized 92 or open 94 as will become apparent from the following description.

FIGS. 9 and 10 respectively show disengaged and engaged positions of upper and lower support members 110 and 120 respectively. As the dig control is activated by the machine operator, pilot valve opens automatically and causes hydraulic valve 132 to open and complete the circuit. As soon as the swing circuit is triggered, pilot pressure goes off, the dydraulic valve 132 spring shifts the valve spool and closes the pressure port from 130; and opens the port between line 134 and 136 and dumps the hydraulic fluid from cylinder 112 to the reservoir 92.

For lift crane application same circuit is used with "on and off" manual switch or hydraulic valve instead of automatic pilot control. The automatic pilot control is necessary for digging or excavating machines.

The alternate embodiment of FIG. 4 is basically the same hydraulic circuit as FIG. 3. In this circuit as the hydraulic valve 132 spool shifts, it connects line 130 to line 138, instead of closing the line 130 port as mentioned in previous discussion of FIG. 3 circuit. This pressure from line 130 performs the same functions as the spring 140 on hydraulic cylinder 112 in FIG. 3. The circuit in FIG. 4 provides better control of cylinder 114 rod movement in both directions. As the spool shifts on hydraulic valve 132, it also connects line 134 to line 136 and dumps the oil from line 136 into the reservoir 94.

The operation of electromagnet, i.e. flux as the medium of transfer of loads from the upper frame unit 10 to ground via lower frame unit 20 can be understood by examining FIG. 15. As soon as the revolving frame 10 is loaded, switches 177 and 178 are closed. Forces in the electromagnets 171 nd 174 vary in direct proportion to force on the revolving frame. Since there is no direct physical contact between the upper and lower load carrying members 10 and 20 respectively, there is nothing to wear and therefore the reliability is high.

Figure 16:
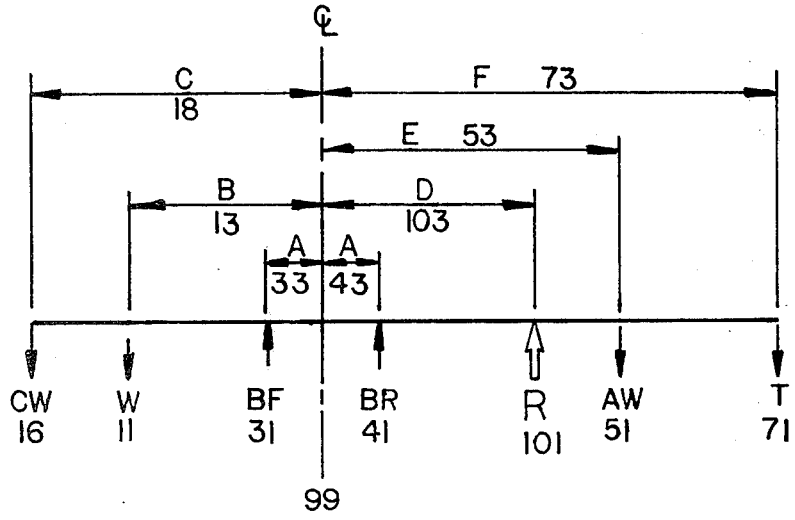
FIG. 16 is a free body diagram of moments for computation of size and location of upper and lower support members.

The distance of the reaction 101 from the center of rotation of the crane or excavator is inversely related to the size of the invention 100. Generally the farthest distance to which this invention can be mounted is limited by the lengths of the upper and lower frames of the excavator 10 and 20 respectively. In order to reduce the size of the cylinder and the forces through it; the invention 100 should be mounted as far away from the center of rotation as possible. FIGS. 1 and 2 illustrate the various forces and counter forces including center of gravity of the excavator and lift crane respectively. FIG. 16 shows the moments of these forces by taking into account relative distances.

Following is the dictionary of memonies used in FIG. 16.

| | |
|---|---|
| C | Center line of rotation of the machine |
| T | Tooth force during digging or hook load during lifting |
| AW | Load of attachments, bucket, boom, cylinders, job, etc. |
| BR | Slewing bearing reaction force |
| BF | Slewing bearing bolt tension force |
| W | Weight of the upper machine (from slewing bearing up) |
| CW | Counter weight |
| R | Proposed "load support" design reaction force |
| A | Slewing bearing radius |
| B | Distance of center of gravity of upper machine from center of rotation of the machine |
| C | Distance of center of gravity of counter weight from center of rotation of the machine |
| D | Distance of "load support" reaction from center of rotation of the machine |
| E | Distance of center of gravity of attachments (AW) from center of rotation of the machine |
| F | Distance of vertical load, tooth force (T) from center of rotation of the machine |

Following formulae may be used for computation of size and location of load support.

$$A \cdot BF + B \cdot W + C \cdot CW = A \cdot BR + D \cdot R + E \cdot AW + F \cdot T$$

$$R = \frac{A \cdot BF + B \cdot W + C \cdot CW - A \cdot BR - E \cdot AW - F \times T}{D}$$

ASSUME $A \cdot BF = K_1$ $\quad A \cdot BR = K_4$ $B \cdot W = K_2$ $\quad E \cdot AW = K_5$ $C \cdot CW = K_3$ $\quad F \cdot T = K_6$ $$R = \frac{K_1 + K_2 + K_3 - K_4 - K_5 - K_6}{D}$$

Since $K_1 = K_4$ Therefore $$R = \frac{K_2 + K_3 - K_5 - K_6}{D}$$

$K_2$ and $K_3$ are generally constant $K_2 + K_3 = C_1$ $$R = \frac{C_1 - K_5 - K_6}{D}$$

Assume during swing R=0

$C_1 = K_5 + K_6$ by substituting $C_1 K_2 + K_3 = K_5 + K_6$

If there is no counter weight therefore $K_3 = 0$ $K_2 = K_5 + K_6$ by substituting $K_2$, $K_5$, $K_6$

B.W=E.AW+F.T

The inventor claims:

1. In a vehicle comprising a ground engaging carrier frame, a superstructure, turntable means supporting said superstructure on said carrier frame for rotation about a vertical axis, and brace means offset from said turntable means to help support the superstructure and preclude tipping of said superstructure with respect to the ground, to in that manner prevent excessive unbalanced loading of the superstructure and/or the turntable means, the improvement comprising:

said brace means including a vertically oriented linear hydraulic motor comprising a cylinder attached to the superstructure, a piston within the cylinder, a piston rod extending downwardly from said piston through the lower end of the cylinder, a support pad at the lower end of the piston rod and a ground engaging secondary frame positioned outwardly of the main carrier frame and within the swing path of the linear hydraulic motor, whereby extension of the linear hydraulic motor into load applying contact with the secondary frame will result in a transfer of weight from the superstructure through the secondary frame, apart from the main carrier frame; and means for delivering and controlling delivery of hydraulic fluid into and outfrom said cylinder to cause extension and retraction of the piston rod, or to hold the piston rod in a set position.

2. The improvement of claim 1, wherein the linear hydraulic motor includes a spring below the piston which normally biases the piston rod into a retracted position and a hydraulic fluid chamber above the piston, and wherein said means for delivering and controlling delivery of hydraulic fluid into and outfrom said cylinder includes means for delivering hydraulic fluid into said chamber, to cause extension of the piston rod and compression of said spring, and means for removing the hydraulic fluid from said chamber, to permit the spring to extend against the piston to in that manner retract the piston rod.

3. The improvement of claim 1 in which the linear hydraulic motor includes a first hydraulic chamber above the piston and a second hydraulic fluid chamber below the piston, and the means for delivering and controlling delivery of hydraulic fluid into and outfrom said cylinder comprises means for delivering hydraulic fluid into the upper chamber while venting the lower chamber, to cause extension of the piston rod, and means for delivering hydraulic fluid into the lower chamber while venting the upper chamber, to cause retraction of the piston rod.

4. In a vehicle comprising a ground engaging carrier frame, a superstructure, turntable means supporting said superstructure on said carrier frame for rotation about a vertical axis, a boom structure or the like on said superstructure including a boom loading hydraulic component, and brace means offset from said turntable means to help support the superstructure and preclude tipping of said superstructure with respect to the ground, upon operation of the boom loading hydraulic component, to in that manner prevent excessive unbalanced loading of the turntable means, the improvement comprising:

said brace means including a vertically oriented linear hydraulic motor comprising a cylinder attached to the superstructure, a piston within the cylinder, a piston rod extending downwardly from said piston through the lower end of the cylinder, and a support pad at the lower end of the piston rod;

and means for delivering and controlling delivery of hydraulic fluid into and outfrom said cylinder to cause extension and retraction of the piston rod, or to hold the piston rod in a set position, including means for automatically and simultaneously delivering hydraulic fluid to the cylinder, to extend the piston rod, in response to a delivery of hydraulic fluid to the boom loading hydraulic component on the superstructure.

5. The improvement of claim 4, wherein the brace means further includes a ground engaging secondary frame positioned endwise of the main carrier frame and within the swing path of the linear hydraulic motor, whereby extension of the linear hydraulic motor into load applying contact with the secondary frame will result in a transfer of weight from the superstructure through the secondary frame, apart from the main carrier frame.

6. The improvement of claim 4, in which the carrier frame comprises opposite ends aligned with each other and opposite sides aligned with the direction of travel, and said vehicle further includes a shelf structure on at least one of its sides, including an upper reaction surface which is within the swing path of the hydraulic linear motor, so that the superstructure can be rotated to place the linear hydraulic motor above such reaction surface and said linear hydraumotor can be extended to apply a bracing force between the superstructure and the shelf portion, and said vehicle includes means for transferring such bracing force substantially directly to the ground.

7. The improvement of claim 6, wherein the brace means further includes a ground engaging secondary frame spaced endwise of the carrier frame, said secondary frame including an upper reaction surface which is within the swing path of the linear hydraulic motor, so that the superstructure can be rotated to place the linear hydraulic motor over such surface, and the linear hydraulic motor can be extended into load transferring contact with such surface, to in that manner brace the superstructure direct through said secondary frame to the ground, apart from the main frame.

8. In a vehicle comprising a ground engaging carrier frame, a superstructure, turntable means supporting said superstructure on said carrier frame for rotation about a vertical axis, and brace means offset from said turntable means to help support the superstructure and preclude tipping of said superstructure with respect to said carrier frame, to in that manner prevent excessive unbalanced loading of the turntable means, the improvement comprising:

said brace means including a vertically oriented extendable—retractable strut means attached to the superstructure;

a ground engaging secondary frame positioned endwise of the main carrier frame and within the swing path of the extendable—retractable strut means, whereby extension of the strut means into load applying contact with the secondary frame will result in a transfer of weight from the superstructure to the ground, through the secondary frame and apart from the main carrier frame.

9. The improvement of claim 8, wherein said secondary frame comprises at least one ground engaging roller.

10. The improvement of claim 9, wherein said roller is mounted in a floating structure.

* * * * *